US009879442B2

(12) United States Patent
Magnuson et al.

(10) Patent No.: US 9,879,442 B2
(45) Date of Patent: Jan. 30, 2018

(54) DRILLING RIG COLUMN RACKER AND METHODS OF ERECTING SAME

(71) Applicant: Nabors Industries, Inc., Houston, TX (US)

(72) Inventors: Christopher Magnuson, Houston, TX (US); Steven K. Deel, Cypress, TX (US)

(73) Assignee: Nabors Industries, Inc., Houston, TX (US)

( * ) Notice: Subject to any disclaimer, the term of this patent is extended or adjusted under 35 U.S.C. 154(b) by 15 days.

(21) Appl. No.: 14/753,328

(22) Filed: Jun. 29, 2015

(65) Prior Publication Data

US 2016/0376808 A1 Dec. 29, 2016

(51) Int. Cl.

| | |
|---|---|
| ***E21B 15/00*** | (2006.01) |
| ***E21B 19/12*** | (2006.01) |
| ***E04H 12/34*** | (2006.01) |
| ***E21B 19/14*** | (2006.01) |
| ***E21B 19/15*** | (2006.01) |

(52) U.S. Cl.

CPC ..... *E04H 12/345* (2013.01); *E21B 15/00* (2013.01); *E21B 19/12* (2013.01); *E21B 19/14* (2013.01); *E21B 19/155* (2013.01)

(58) Field of Classification Search

CPC ..... E21B 19/155; E21B 15/003; E21B 15/00; E21B 19/15; E21B 19/14; E21B 19/086; E21B 19/083; E21B 19/08; E21B 19/00

See application file for complete search history.

(56) References Cited

U.S. PATENT DOCUMENTS

| | | | | | |
|---|---|---|---|---|---|
| 1,829,879 | A | * | 11/1931 | Stephens | E21B 19/155 104/126 |
| 2,696,039 | A | * | 12/1954 | Baker | E21B 17/006 166/85.5 |
| 3,532,229 | A | * | 10/1970 | Scaggs | E21B 19/155 414/22.58 |
| 3,716,149 | A | * | 2/1973 | Scaggs | E21B 19/155 414/22.52 |
| 3,865,256 | A | * | 2/1975 | Freeman, Sr. | E21B 19/155 414/22.54 |
| 4,024,925 | A | * | 5/1977 | Brown | E21B 19/155 173/147 |
| 4,067,453 | A | * | 1/1978 | Moller | E21B 19/155 175/85 |
| 4,157,129 | A | * | 6/1979 | Christopher | E04G 1/20 182/114 |

(Continued)

*Primary Examiner* — Phi A

(74) *Attorney, Agent, or Firm* — Haynes and Boone, LLP

(57) ABSTRACT

Methods for erecting a drilling structure on a drilling rig include hoisting a first end of a column racker with a support carried by a mast on the drilling rig while the column racker is in a first position, and advancing a second end of a column racker along a solid surface toward the mast while simultaneously hoisting the first end of the column racker to move the column racker toward a second position that is closer to vertical than the first position. Other methods include raising a first end of a column racker with a ground-based, powered lift structure, and introducing the first end of the column racker to the rig floor while supporting the weight of the column racker with the ground-based, powered lift structure.

28 Claims, 10 Drawing Sheets

(56) References Cited

U.S. PATENT DOCUMENTS

| | | | | |
|---|---|---|---|---|
| 4,315,709 | A * | 2/1982 | Gulick | E21B 19/155 414/22.57 |
| 4,403,898 | A * | 9/1983 | Thompson | E21B 19/155 175/85 |
| 4,598,509 | A * | 7/1986 | Woolslayer | E02B 17/00 52/115 |
| 9,518,432 | B2 * | 12/2016 | Miranda | E21B 19/155 |
| 2005/0152772 | A1 * | 7/2005 | Hawkins, III | E21B 19/155 414/22.54 |
| 2008/0253866 | A1 * | 10/2008 | Lops | E21B 19/155 414/22.55 |
| 2010/0319932 | A1 * | 12/2010 | Angelle | B66C 1/12 166/380 |
| 2011/0044787 | A1 * | 2/2011 | Fikowski | E21B 19/155 414/22.59 |
| 2011/0226530 | A1 * | 9/2011 | Tarique | E21B 19/155 175/27 |
| 2013/0186643 | A1 * | 7/2013 | Angelle | B66C 1/12 166/380 |
| 2013/0277508 | A1 * | 10/2013 | Trevithick | E21B 15/00 248/49 |
| 2013/0291475 | A1 * | 11/2013 | Ruttley | E21B 15/00 52/650.3 |
| 2013/0327543 | A1 * | 12/2013 | Reddy | E21B 19/14 166/381 |
| 2015/0114717 | A1 * | 4/2015 | Fortson | E21B 15/003 175/57 |
| 2015/0184472 | A1 * | 7/2015 | Miranda | E21B 19/155 414/22.58 |
| 2016/0090797 | A1 * | 3/2016 | Holck | E21B 19/155 414/22.63 |
| 2016/0319610 | A1 * | 11/2016 | Magnuson | G01G 19/52 |

* cited by examiner

DRILLING RIG COLUMN RACKER AND METHODS OF ERECTING SAME

TECHNICAL FIELD

This disclosure relates to the field of erecting drilling rig structures. More particularly, this disclosure relates to the field of erecting a drilling rig column racker.

BACKGROUND OF THE DISCLOSURE

Exploration and production of petroleum, including oil and gas, requires the use of drilling rigs to drill wells deep in subterranean formations. These wells are expensive to both drill and operate. A typical operating drilling rig includes a substructure, a drill floor, and a vertical mast with a crown mounted thereon. The mast typically has a travelling block reeved with wire rope from a drawworks to the crown, enabling the travelling block to be raised and lowered. A top drive is connected to the block for drilling the well. The drill floor typically includes the drawworks, an automated roughneck, and a rotary table with a bowl to accept manual or automated slips for the securing and holding of tubulars.

Advancements in technology have permitted deeper wells, which in turn have resulted in a need to have drill floors be higher above the ground in order to accommodate larger and more complex equipment, such as blow-out preventers (BOPs) with more cavities and rotating BOPs. Introducing large components, such as a column racker, to the high drill floors during rig setup can be challenging. Column rackers present particular challenges because they may bend if care is not taken when moving a full length column racker from a horizontal position to a vertical position. Because of this, conventional column rackers are introduced to a drill floor using one of two techniques. In a first technique, the column racker is introduced to the drill floor in an unassembled configuration. For example, smaller length segments are introduced to the drill floor, and then the segments are joined to form a single column racker in a vertical condition. In a second technique, the column racker is assembled in a horizontal condition, and two cranes hoist the column racker from the ground and carefully tip the column racker from a substantially horizontal condition to a more vertical condition, and the column racker is then introduced onto the rig floor by the cranes. Due to its length and size, and the need to avoid any inelastic bend of the column racker, placing an assembled column racker onto a rig can be a slow and challenging endeavor. Further, some drill sites are in areas that make crane transport and setup difficult.

The present disclosure is directed to overcoming one or more of the deficiencies of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
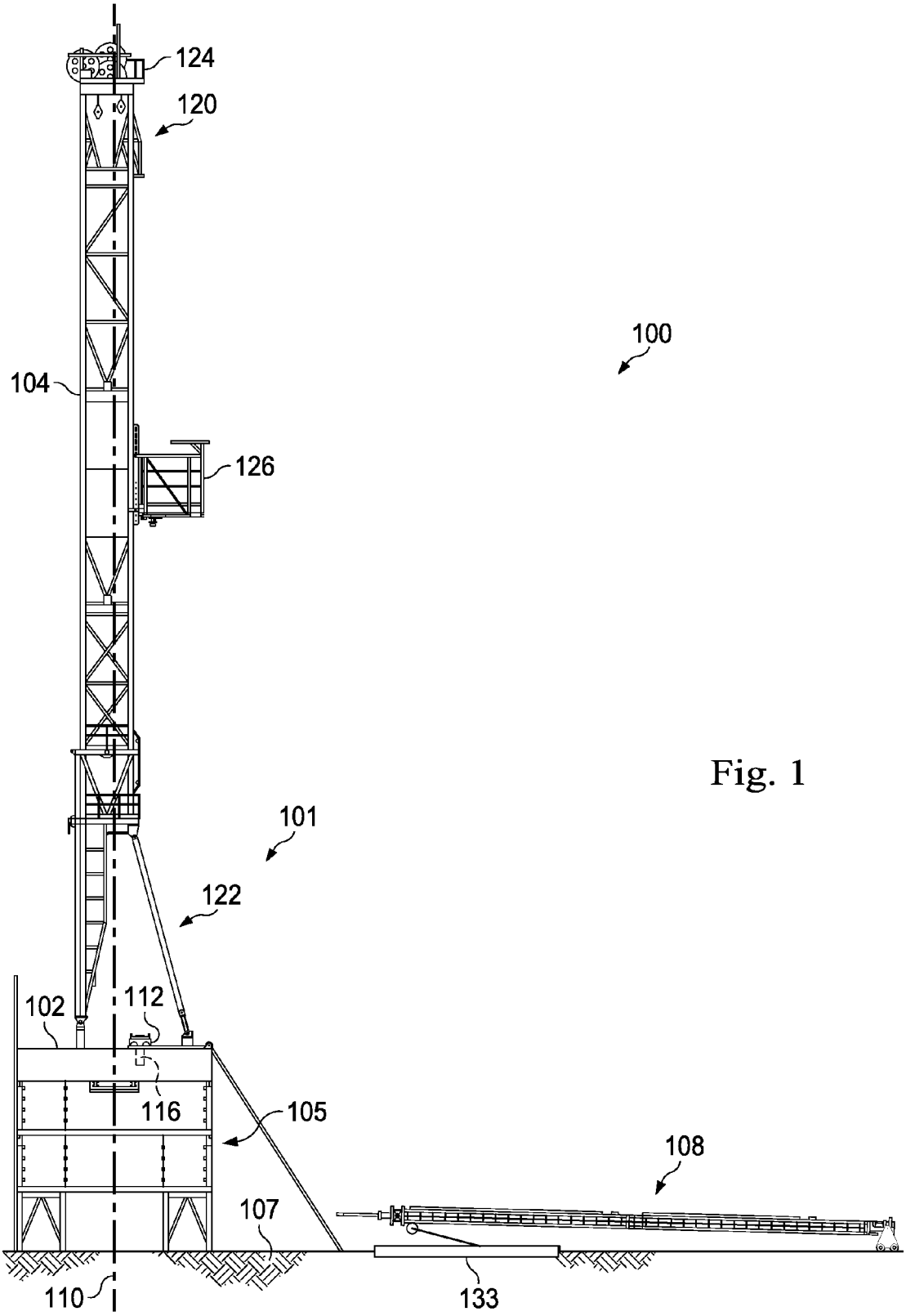
FIG. 1 is a side view of an apparatus with a column racker to be introduced to a rig floor according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The apparatuses and methods described in the present disclosure may enable more efficient setup of drilling apparatuses, such as drilling rigs, by enabling faster and safer column racker setup on a rig floor than conventional systems and methods. Some embodiments may also result in additional efficiencies because these apparatuses and methods may permit rig operators to assemble and rig-up the column racker while the column racker is on the ground in a horizontal position, and then introduce the assembled and rigged-up column racker onto the drilling rig. In addition, some implementations provide these advantages without the use of cranes. This may result in faster, safer, less expensive, and less troublesome setup than conventional setup methods and apparatuses.

Because the column racker may be assembled to its total length in a horizontal condition, it may be rigged up with all hoses, wiring, and cables in place and ready for final connection to the drilling rig. It may then be raised and installed on the drilling rig. As such, final setup on the rig may include merely connecting the column racker hoses and connectors to the rig connectors. This may make column racker setup relatively quick and efficient after the column racker is positioned on the rig.

At least some of the advantages of the methods and systems of the present disclosure may be achieved using an assembly trolley and a column racker support structure. In some implementations, the support structure may form a part of the transportation skid used to transport the column racker. The support structure may lift and raise a portion of the column racker to the drill floor, while the assembly trolley carries a lower end of the column racker along the ground or other surface, such as a ramp, to the drilling rig floor. Some methods include raising the column racker off the assembly trolley and lowering it onto a racker trolley, already disposed on the drilling rig. In some embodiments, the racker trolley is already attached in place to the rig floor.

FIG. 1 illustrates a schematic view of a drilling rig apparatus 100 demonstrating one or more aspects of the present disclosure. In some examples, the apparatus 100 may form a part of a land-based, mobile drilling rig. One or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The drilling rig apparatus 100 shown in FIG. 1 includes a drilling rig 101 with drill floor 102 and a mast 104 supported or extending from the drill floor 102, all disposed above a substructure 105. An assembled column racker 108 of the drilling rig apparatus 100 is disposed off of the drilling rig 101, and shown in the horizontal position adjacent the drill floor 102. The drill floor 102 may be sized in a range of, e.g., about 35×35 feet, although larger and smaller rigs are contemplated. In some embodiments, the drilling rig apparatus 100 may have a drill floor size of less than approximately 1600 square feet. In other embodiments, the drilling rig apparatus 100 may have a drill floor size of less than approximately 1200 square feet. The drill floor 102 supports rig-based operations and rig equipment, including the mast 104.

As can be seen, the drill floor 102 is located above the substructure 105 and over a well center 110, which extends downward through the substructure 105. In this embodiment, the drill floor 102 includes a racker trolley 112 disposed thereon. The racker trolley 112 may be connected to a track on or forming a part of the drill floor 102. The racker trolley 112 is arranged to connect with and carry the column racker 108 when the column racker is properly disposed for operation on the drill floor 102. The racker trolley 112 moves along the track, such as by rolling or advancing along wheels, rollers, conveyers, or other mechanisms to move tubulars or other components from a first position in the drilling rig to another location on the drilling rig.

In the exemplary embodiment shown, a lifting element 116, which may be a hydraulic cylinder or other mechanism, may be used to move the column racker 108 onto the racker trolley 112. The lifting element 116 in this embodiment is disposed below the drill floor 102 and is arranged to lift the column racker 108 onto the racker trolley 112 during the rig assembly process, when the column racker is in a relatively vertical condition on the drilling rig apparatus 100. This will become more apparent in the description below.

The mast 104 is disposed on the drill floor 102 in a manner that enables it to conduct operations over well center 110 to accomplish desired drilling tasks. The substructure 105 supports the drilling structure, such as the drill floor 102, on the surface (e.g., the ground 107) through which drilling is to occur. It may include one or more struts braces, beams or supports for maintaining the drill floor 102 above the ground 107.

The mast in FIG. 1 is shown in the upright position and anchored in place to the drill floor 102. It may have a height in the range of about 110-160 feet, although other lengths, both larger and smaller, are contemplated. The mast 104 is configured to support drilling equipment, such as hoisting equipment including, for example, a travelling block and a top drive or other equipment, that may be raised and lowered to drive a drill string or other drilling equipment downward into the well or take the drill string out from the well.

In the exemplary embodiment shown, the mast 104 includes an upper end 120 and a lower end 122. The lower end 122 connects to the drill floor 102. The mast 104 may be comprised of one single module or a plurality of components connected together. The upper end 120 of the mast 104 includes a crown block 124 that may include one or more sheaves or other elements that may be used to raise and lower drilling equipment in the mast 104. In this embodiment, a fingerboard 126 is supported by and carried on the mast 104. The fingerboard 126 may include components and/or features that enable it to cooperate with the column racker 108 when the column racker is in the vertical condition. In one exemplary aspect, the fingerboard 126 includes a column racker track or a trolley that may connect with and support or stabilize an upper end of the column racker 108 when the column racker 108 is in a vertical or upright position over the drill floor 102. Although shown extending from the mast 104, other implementations include a fingerboard supported on a separate derrick.

As indicated above, in the exemplary rig apparatus 100 of FIG. 1, the column racker 108 is disposed in a horizontal condition on the ground 107. In this horizontal condition on the ground, column racker assembly and rig-up may be more easily accomplished if not previously assembled off-site. Once assembled and rigged-up, the column racker 108 may be erected and operationally coupled to the rest of the drilling rig 101. This may be more efficient, more cost-effective, with lower risk of damage to the rig and other equipment than conventional setup systems and methods. For example, one or more of these advantages may arise because, unlike conventional assembly where a column racker is installed in segments on the drilling rig, the methods and systems disclosed herein may permit racker assembly to occur previously or on the ground in a horizontal condition, and then the assembled column racker may be raised in a fully assembled condition from the ground onto the drilling rig floor 102. In addition, one or more advantages may arise because there is no requirement that separate cranes, which can be unwieldy in some environments, be brought in to assist with erecting the column racker of the drilling rig apparatus 100.

Figure 2:
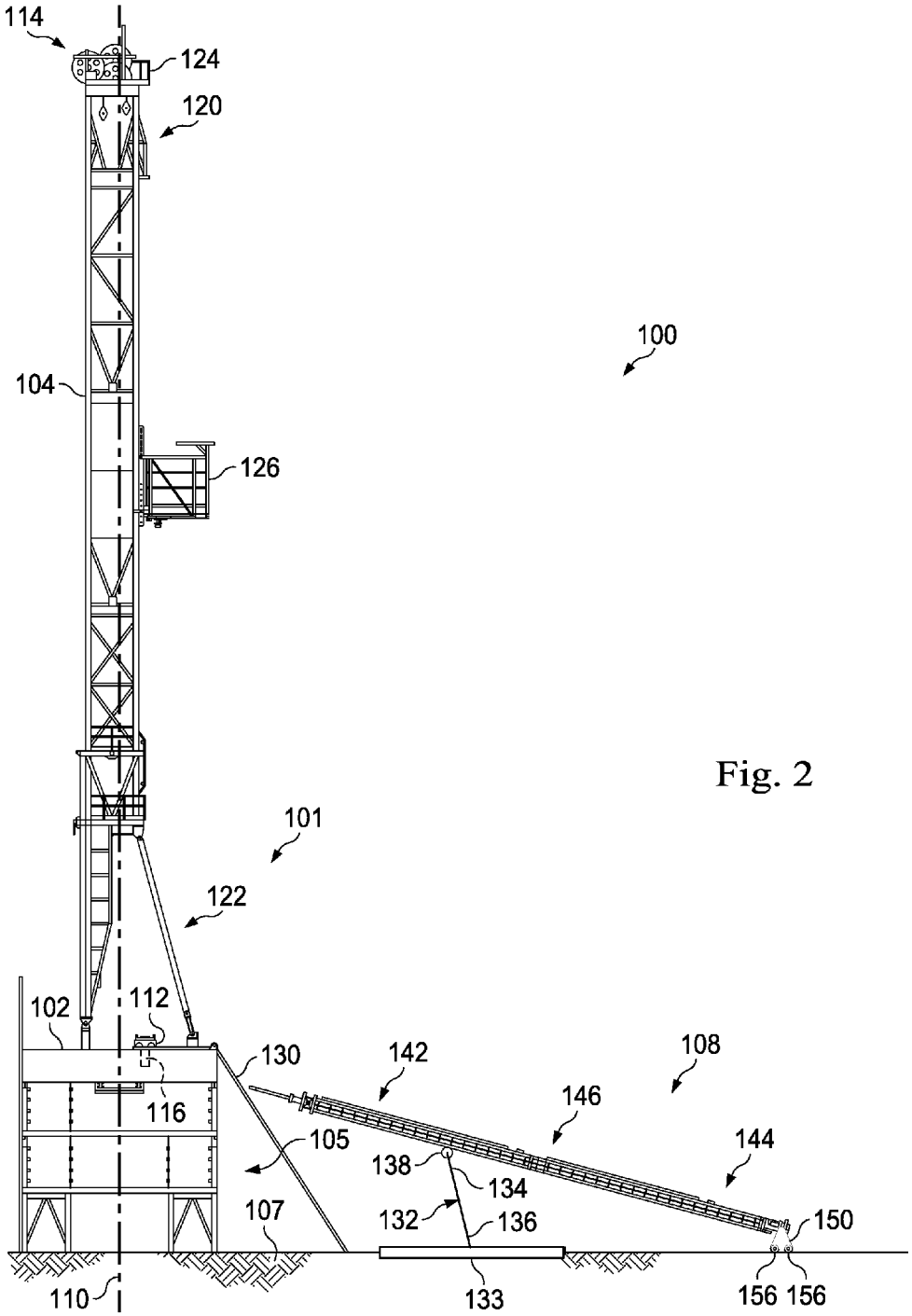
FIG. 2 is a side view of an apparatus with a column racker carried by a lifting structure and an assembly trolley according to one or more aspects of the present disclosure.

FIGS. 2-8 show the column racker 108 being introduced to the drilling rig floor 102 and arranged for drilling operations. In FIG. 2, the drilling rig apparatus 100 includes a ramp 130 and a lift structure 132. The ramp 130 extends from the ground 107 or some other elevation to the drill floor 102. The ramp angle may be dependent on the height of the drill floor above the ground level topography or other factors. In the example shown, the ramp 130 is angled greater than 45 degrees, however, other ramps may be angled at any desirable angle. For example, some ramps are angled in the range of about 30-60 degrees from horizontal. Other ramps have other angles. The angle may be determined based on topography and the height of the drill floor 102. The ramp 130 is structured to support the weight of the assembled column racker 108 as the column racker 108 advances up the ramp in a manner discussed herein.

The lift structure 132 is configured to raise an end of the column racker 108 for introduction to the drilling rig floor 102. In some embodiments, the lift structure 132 is a part of a skid, such as a skid 133, that may be transported from place to place. Depending on the embodiment, the skid 133 may be the same skid used to transport the column racker 108 to the rig site. For example, some skids are used to transport the column racker in a disassembled configuration. In a particular example, a singled skid may be used to transport multiple column racker segments. These may be joined together at the rig site on the ground to form the complete column racker. In some embodiments, the column racker is formed of two segments, joined end to end. The lift structure 132 on the skid 133 may then be used to lift a portion or the entire column racker so that it can be introduced to the rig floor. Accordingly, the skid may be used to transport the column racker, and may also include a lift structure that helps introduce the column racker to the drill floor 102. Other embodiments have a lift structure, such as a lift skid, separate from a transportation skid.

The lift structure is a ground-based, powered mechanism arranged to physically lift all or a portion of the assembled column racker from a horizontal position to a more vertical position. It may be electrically powered, hydraulically powered, or otherwise powered and may include lifts, pumps, engines, or motors, etc. In some arrangements, it is configured to lift the column racker without the use of a crane. The lift structure 132 may operate via hydraulic motor or other system to raise the end of the column racker toward the drilling rig. In the exemplary embodiment shown, the lift structure 132 includes a racker portion 134 and a ground portion 136. The racker portion 134 engages the column racker 108 and may be used to help raise the column racker 108 from the ground towards the drill floor 102. The racker portion 134 may include racker engagement elements, such as wheels or rollers 138, or may include conveyers or other engagement elements that interface with the column racker. The ground portion 136 may be a pivot connection or other connection that allows the lift structure 132 to pivot about a point and support at least a portion of the weight of the column racker 108. The ground portion 136 may be disposed on the skid 133 or directly on the ground. In the exemplary embodiment shown, the ground portion 136 is fixed in place while the lift structure 132 pivots about the ground portion 136. In alternative embodiments, the ground portion 136 may move in a horizontal direction along the skid 133 or along the ground, or along a track in a lateral or horizontal direction in order to maintain and support the column racker 108. In the exemplary embodiment shown in FIG. 2, the lift structure 132 is in a relatively vertical position and is engaged with the column racker 108. Some embodiments of the lift structure 132 have an extendable arrangement that allows the lift structure 132 to change in length as it lifts the column racker. Depending on the embodiment, it may do this using a telescoping arrangement, a folding arrangement or other mechanism arrangement or structure that increases the length or height of the lift structure 132. In some embodiments, the lift structure is a hydraulic arm moveable by pivoting about a connection point or by telescoping from a retracted position to an extended position in a manner that raises the first end of the column racker. In some embodiments, the lift structure 132 may be a portion of a catwalk that may perform the dual function of introducing tubulars over the drill rig floor 102.

With reference to FIG. 2, the column racker 108 includes an upper end portion 142, a lower end portion 144, and a central portion 146 disposed therebetween. In this embodiment, the column racker 108 is shown partially raised from the ground by the lift structure 132, which engages the upper end portion 142 of the racker 108 or the central portion 146. As shown in FIG. 2, the lower end portion 144 of the column racker 108 is supported by a bogie or assembly trolley 150. The assembly trolley 150 and the lift structure 132 cooperate to raise the column racker 108 from a horizontal position towards a more vertical position. The assembly trolley 150 carries the weight of the column racker 108 as it advances along the ground 107 towards the drilling rig structure 100.

The assembly trolley 150 may include wheels 156, conveyors, or rollers that enable the assembly trolley to advance over the ground 107, the skid 133, and/or up the ramp 130 to the drill floor 102. In the example shown, the assembly trolley 150 includes a set of front wheels and a set of rear wheels that cooperate to carry the weight of the column racker 108. In some embodiments, the assembly trolley is non-powered and is displaced based on movement of the column racker 108. Other assembly trolley embodiments may include a motor and/or transmission that allow the assembly trolley 150 to roll toward the drilling rig 101 while carrying the lower end 144 of the column racker 108. The assembly trolley 150 may be connected to the lower end 144 of the column racker 108 in a permanent or temporary manner. In some embodiments, the assembly trolley 150 is bolted to the column racker, and in other embodiments, the assembly trolley 150 is welded to the column racker. In yet other embodiments, the assembly trolley is shaped to receive the column racker 108 without a mechanical connection and to carry the column racker with minimal slipping. The assembly trolley 150 may be weighted or otherwise disposed in coupled fashion to a track or other structure (e.g., an extension from the skid) to help maintain the trolley 150 adjacent the ground or other structure until the column racker 108 is in a more vertical position and the trolley 150 is adjacent the ramp 130.

Figure 3:
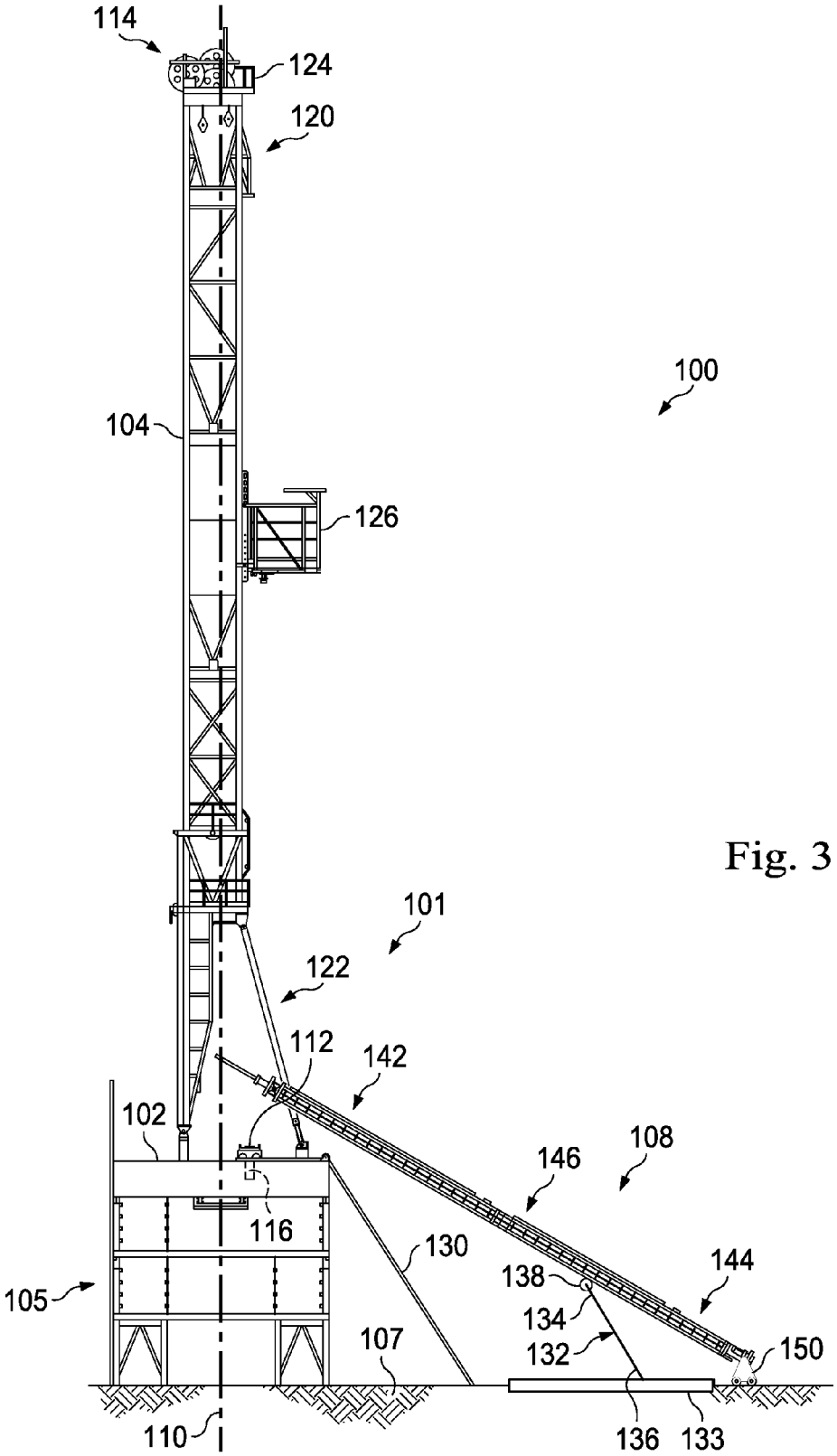
FIG. 3 is a side view of an apparatus with a column racker carried by a lifting structure and an assembly trolley according to one or more aspects of the present disclosure.

FIG. 3 shows the column racker 108 in a more vertical condition and being introduced to the drilling rig 101. Here, the lift structure 132 has raised the column racker 108 so that the upper end 142 is above the drill floor 102 and the column racker has been advanced laterally relative to the lift structure 132. In some embodiments, the column racker 108 is introduced to the drill floor 102 through a V-door. Because of the arrangement herein, this can be accomplished without the use of one or more cranes.

The column racker 108 is moved laterally along the ground 107 and the lift structure 132 toward the drill floor 102. The lower end portion 144 carried by the assembly trolley 150, rolls along the ground 107, the skid 133, or other structure to move the column racker 108 toward the drill floor 102. Here, the upper end portion 142 of the column racker 108 extends over the drill floor 102 and as shown, extends over the well center 110. Accordingly, it may align with and may be arranged to be connected with hoisting components 114 carried by the mast 104. For example, the upper end portion 142 of the column racker 108 may be arranged to connect with hoisting components 114 such as, for example, the travelling block, the top drive, cables, the crown block 124, pulleys, sheaves and/or other structures that may be used to raise the column racker 108 from a horizontal condition to a more vertical condition. The draw-works (not shown) may control the hoisting components 114 to lift the column racker 108 upwardly adjacent the mast 104. With the column racker 108 connected to the hoisting components 114, the column racker may be raised above and off the lift structure 132. The lower end portion 144 of the racker 108 may continue to advance toward the drill rig 100 on the assembly trolley 150. In some embodiments, the column racker 108 is pinned to the hoisting components 114 so that the column racker 108 may be lifted upwardly. In some embodiments, the column racker 108 is pinned or otherwise connected to the travelling block. Other arrangements are also contemplated for hoisting the upper end of the column racker 108.

Advantages of the assembly methods and systems disclosed herein arise in part because the need for cranes that connect to the column racker are no longer needed. Instead, the column racker may be lifted by connections at a single point along the axis, and the connection may be via the hoisting components 114 on the drilling rig apparatus. In the example described, the single axial point is disposed at the upper end portion 142. Because of this, multiple connection points are no longer needed, increasing the set-up efficiency of the overall drilling rig apparatus.

Figure 4:
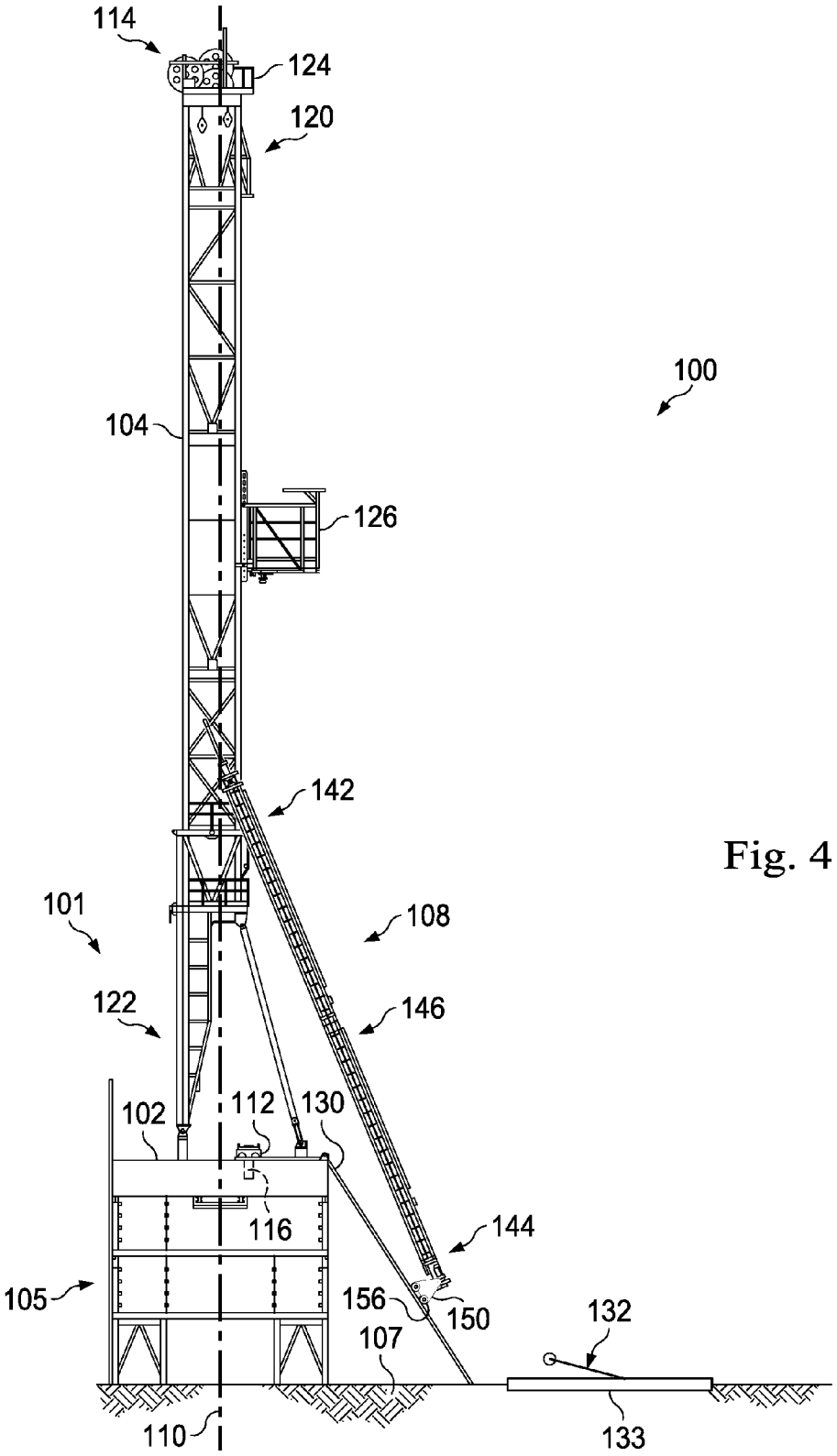
FIG. 4 is a side view of an apparatus with a column racker carried by hoisting components and an assembly trolley according to one or more aspects of the present disclosure.

FIG. 4 shows the column racker 108 being hoisted by the hoisting components 114 of the mast 104. For example, in implementations where the column racker 108 is attached to or carried by the travelling block, the upper end portion 142 increases in elevation with the travelling block. Likewise, the column racker 108 may be raised with the top drive. As the upper end portion 142 is elevated along the mast 104, the lower end portion 144 advances along the ground 107 toward the ramp 130, carried by the assembly trolley 150. FIG. 4 shows the assembly trolley 150 advancing along the ramp 130 from ground 107 toward the drill floor 102. As the hoisting components 114 continue to lift the column racker 108 onto the drill floor 102, the assembly trolley 150 also advances and rolls towards the drill floor 102.

Figure 5:
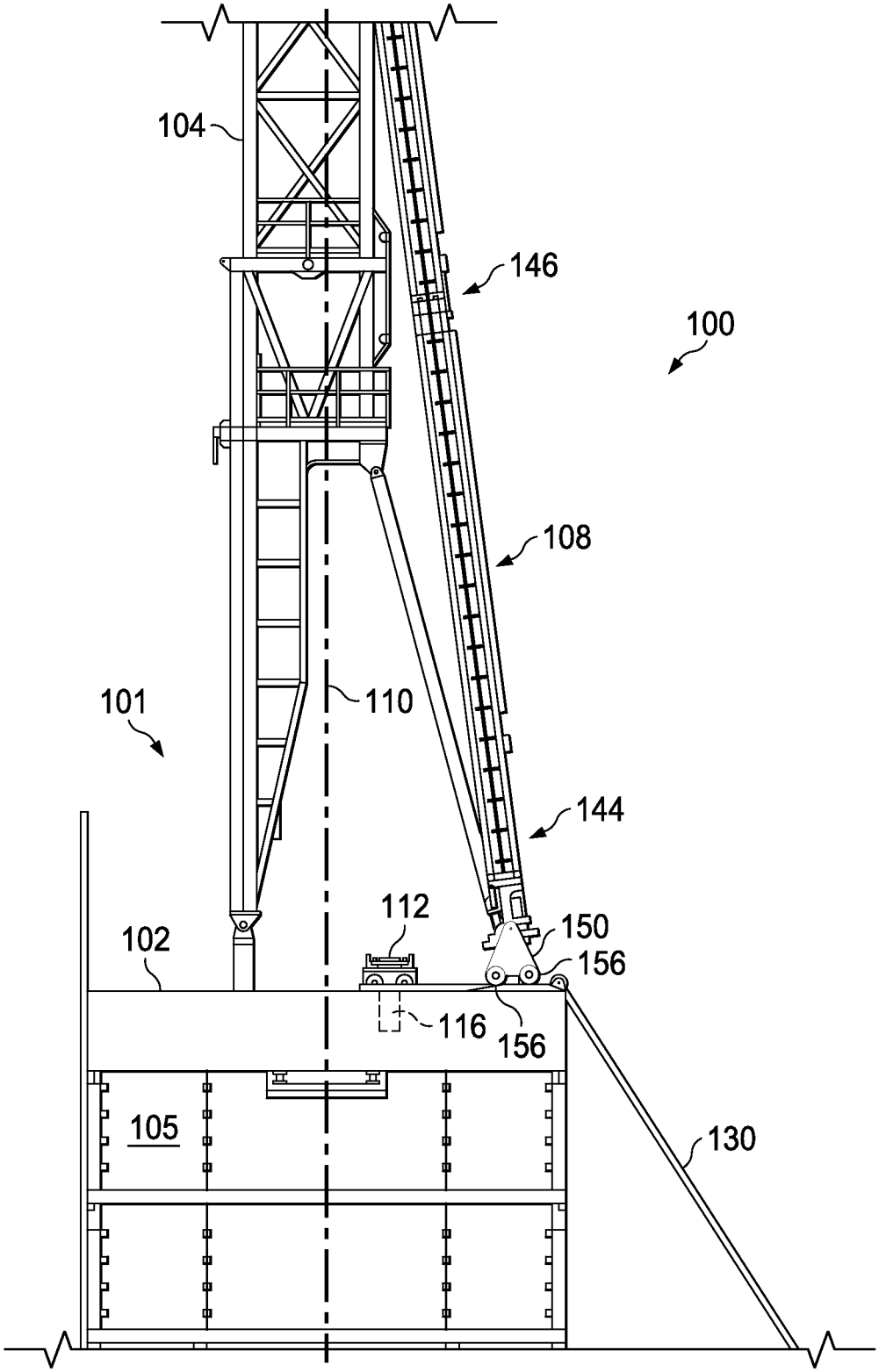
FIG. 5 is a side view of an apparatus with a lower portion of a column racker on an assembly trolley according to one or more aspects of the present disclosure.

FIG. 5 provides additional detail of the lower end portion 144 of the racker 108 and the assembly trolley 150. Here the assembly trolley 150 supports nearly the entire load of the column racker 108 as the column racker 108 has now become substantially vertical. The assembly trolley 150 is shown on the rig floor 102 after having advanced or rolled along the ramp 130.

In some implementations, with the lower end portion 144 of the column racker on the drill floor 102, the column racker 108 may be moved off the assembly trolley 150 and placed on or be associated with the racker trolley 112. The racker trolley 112 is arranged to carry the column racker 108 on the drilling rig 101 as the column racker 108 performs drilling tasks, such as building up or breaking down stands or the drill string, moving tubulars, or performing other drilling tasks.

The column racker 108 may be moved from the assembly trolley 150 to the racker trolley 112 by disconnecting it from the assembly trolley 150, and then attaching it to the racker trolley 112. Disconnecting may include removing pins, bolts or other connectors that may hold the column racker 108 to the assembly trolley 150. The column racker 108 may then be raised above the assembly trolley 150 using the hoisting components 114. In some embodiments where only gravity holds the column racker 108 to the assembly trolley 150, the column racker 108 may be simply lifted from the assembly trolley 150. In yet other embodiments, the assembly trolley 150 may be attached to the column racker 108 in a manner such that the disconnecting step is skipped, and the assembly trolley 150 remains attached to the column racker 108. In such embodiments, the assembly trolley 150 may be lifted with the column racker 108 and placed on the racker trolley 112. For example, the racker trolley 112 can be sized and dimensioned to accommodate the base of the assembly trolley 150, which is simply lowered into the racker trolley 112 with the column racker 108 disposed thereabove. This embodiment may include lifting the column racker 108, arranging the racker trolley 112 beneath the column racker 108 by either moving the column racker 108 or the racker trolley 112, and then lowering the column racker 108 onto the racker trolley 112. The column racker 108 may then be secured to the racker trolley 112 in a manner known in the art, such as through pin connections or other connections.

Some implementations employ the lifting element 116 to raise the column racker 108 vertically off the assembly trolley 150. This may include aligning the assembly trolley 150 with the lifting element 116 associated with the floor 102 of the drilling rig apparatus 100. When properly aligned with or disposed over, the lifting element 116 may be actuated to engage the lower end portion 144 of the column racker 108, and lift it vertically from a lower first position to a higher second position. With the column racker 108 raised or elevated, the assembly trolley 150 may be removed from underneath the column racker 102. The column racker 108 may then then be lowered, via the lifting element 116 from its elevated position to a position on the racker trolley 112.

In some implementations, the lifting element 116 raises trunnions to secure the column racker 108 and allow removal of the assembly trolley 150. The trunnion fixes the column racker against rotation about its axis, but also provides a pivot point about which the column racker may rotate within a single plane. Accordingly, the trunnion may permit the top end portion of the column racker 108 to pivot along a plane about the bottom end portion 144. In some implementations, the top end portion may pivot into a split-block bearing housing forming a part of the upper trolley 164. The lifting element may then lower the column racker 108 onto the racker trolley 112. It may then be secured to the racker trolley 112 using a pin or other type of connection as discussed above. Once securely attached to the racker trolley 112, the trunnions may be removed and the lifting element 116 may be fully retracted so as to completely disengage from the column racker 108.

Figure 6:
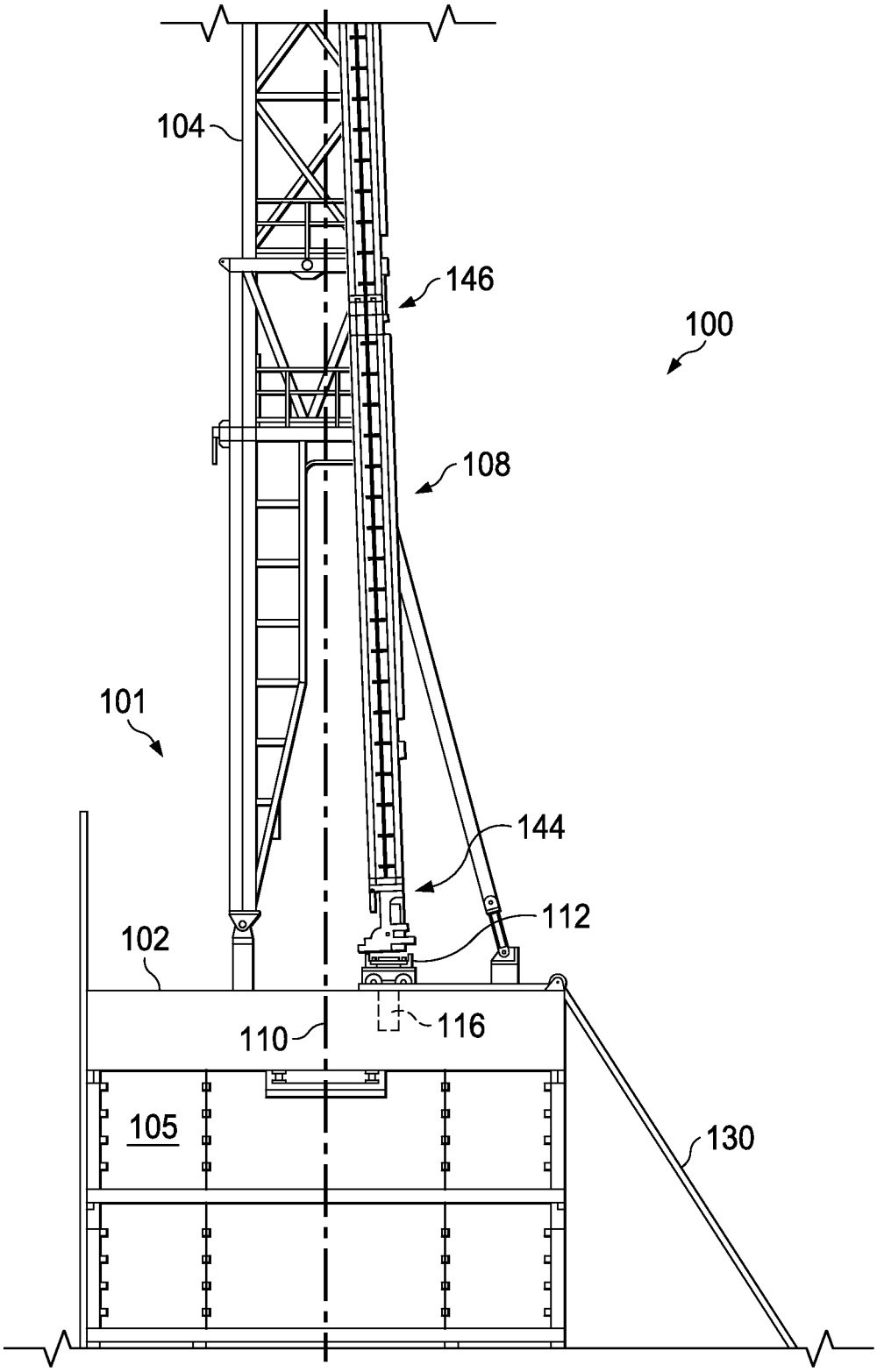
FIG. 6 is a side view of an apparatus with a lower portion of a column racker carried by hoisting components and a racker trolley according to one or more aspects of the present disclosure.

FIG. 6 shows the column racker 108 disposed upon the racker trolley 112. As indicated previously, the racker trolley 112 may be attached to the rig floor 102 or may be arranged to follow a track on the drill floor 102. In some embodiments, it forms a part of a modular element of the drill floor 102. The column racker 108 may then be rigged up by attaching hydraulic and/or electrical hoses and cables from the drilling rig 101. In some implementations, these are carried on the racker trolley 112. With the column racker 108 disposed on and attached to the racker trolley 112, the lower end portion 144 of the column racker 108 is in place for operation.

Figure 7:
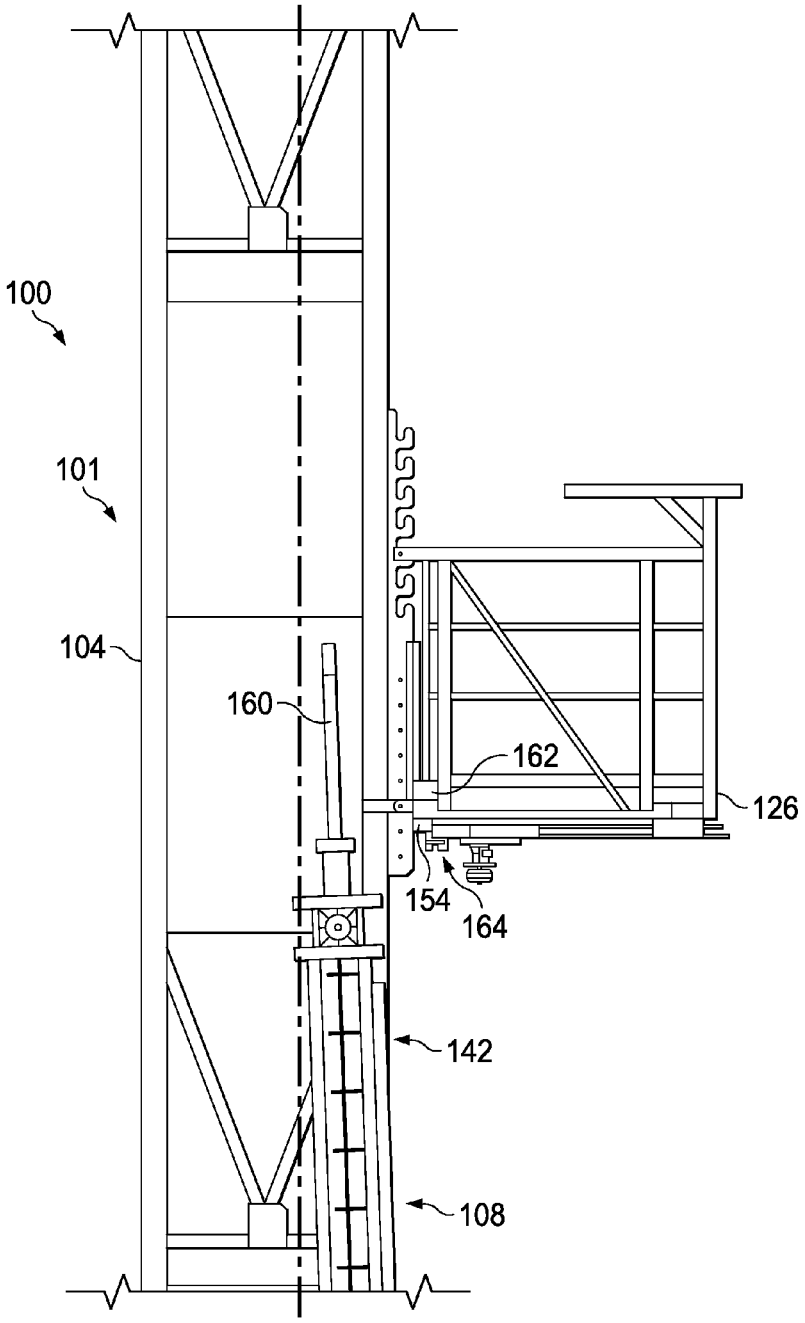
FIG. 7 is a side view of an apparatus with an upper portion of a column racker according to one or more aspects of the present disclosure.

FIG. 7 shows the upper end portion 142 of the column racker 108 relative to the mast 104 and the fingerboard 126. The upper end portion 142 includes a racker interface portion, shown as an extension portion 160, configured to attach to a corresponding fingerboard interface, shown as a bearing assembly 154, on the fingerboard 126. Here, the extension portion 160 is a cylindrical shaft that may be gripped in the bearing assembly 154 and allows the column racker 108 to rotate during use. In this embodiment, the extension portion 160 extends to an elevation above the fingerboard 126, such that it may pass through the fingerboard 126. The extension portion 160 may be arranged to move within a passage or track extending through the fingerboard 126.

The corresponding fingerboard interface on the fingerboard 126 may include the bearing assembly 154. The bearing assembly 154 may be arranged to capture the extension portion 160 of the column racker 108 and move it along a track to perform drilling functions. In some embodiments, the bearing assembly 154 is a split bearing assembly. The fingerboard interface may also include a v-shaped opening that guides the extension portion 160 of the column racker 108 into the split bearing of the bearing assembly 154. In some implementations, when the extension portion 160 is introduced into the split bearing forming the bearing assembly 154, the split bearing is arranged to close and securely hold the extension portion 160. With the extension portion 160 secured to the bearing assembly 154, the column racker 108 may be fully rigged up by connecting hydraulic and/or electrical hoses and cables from the drilling rig for operation of the column racker 108 or other components.

In some embodiments, the bearing assembly 154, forming the fingerboard interface, forms a part of a travelling assembly 162. The travelling assembly 162 may be an assembly that displaces relative to the fingerboard 126 to move the column racker 108 relative to the fingerboard 126. In some implementations, the travelling assembly 162 includes an upper trolley 164. The travelling assembly 162, with the bearing assembly 154 and the upper trolley 164, may form a part of or may be a modular component of the fingerboard 126. In some embodiments, the upper trolley 164 follows a track along the fingerboard 126 extending from one lateral end to the other. This enables the column racker 108 to move along the track and be carried by the upper trolley 164 from one position to another to access tubulars within the fingerboard 126. The column racker 108 may connect to the upper trolley 164 in any suitable manner.

Figure 8:
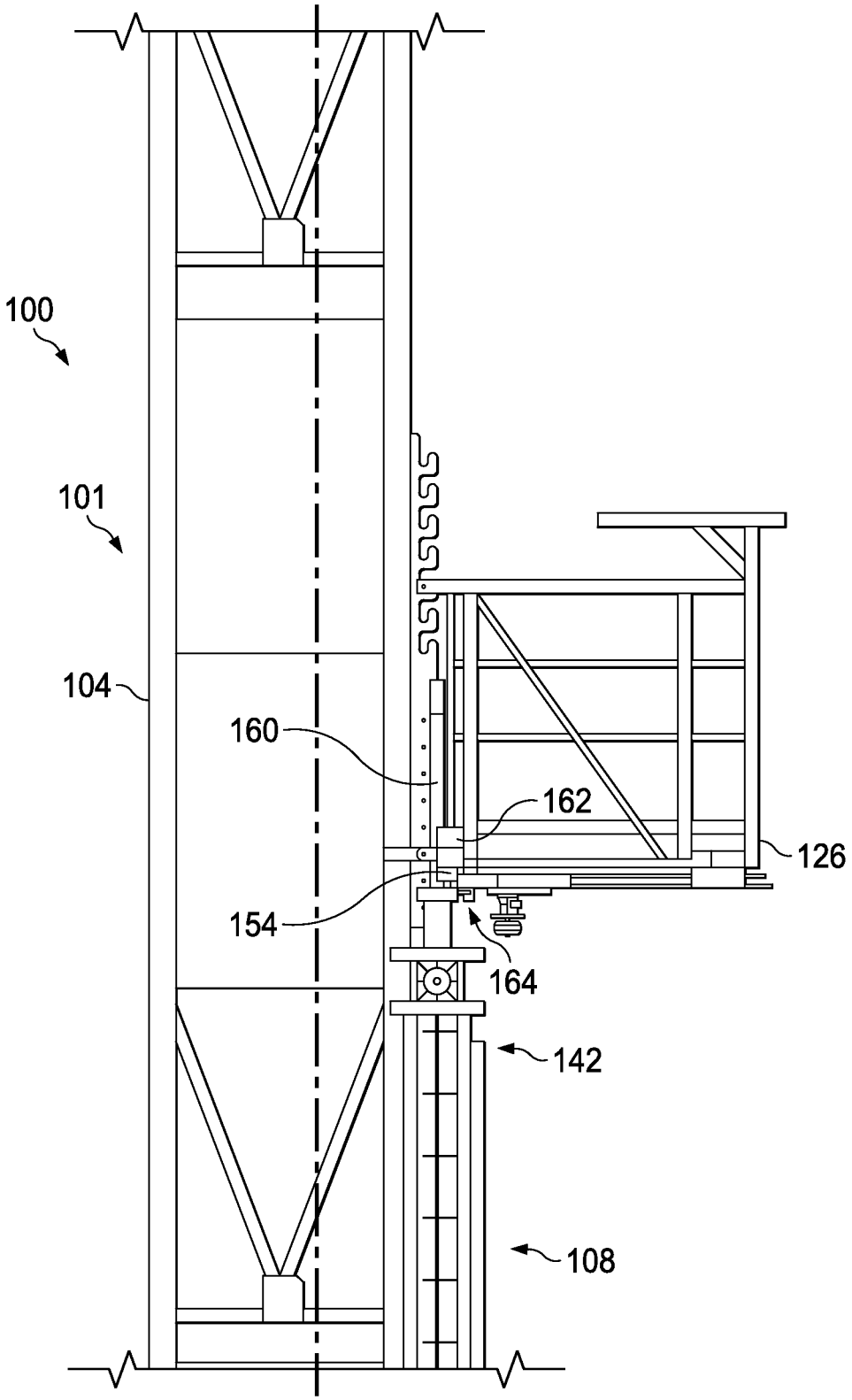
FIG. 8 is a side view of an apparatus with an upper portion of a column racker according to one or more aspects of the present disclosure.

FIG. 8 shows the upper portion 142 of the column racker 108 connected in place for operation. Here, the fingerboard interface (e.g., bearing assembly 154) has captured the racker interface (e.g., extension portion 160), and the column racker 108 is disposed in its vertical, operational position.

Figure 9:
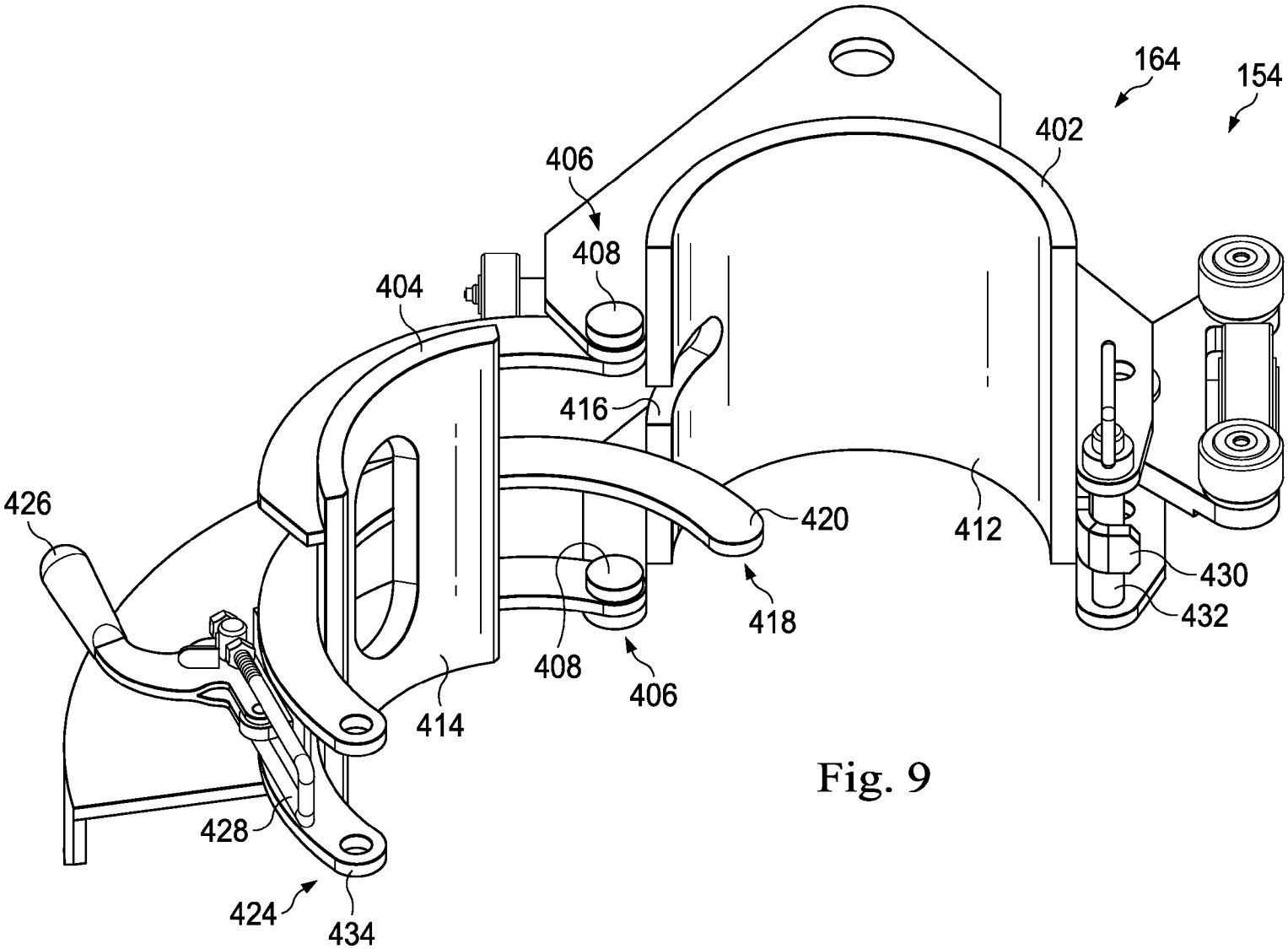
FIG. 9 is a perspective view of an apparatus in an open condition according to one or more aspects of the present disclosure.
Figure 10:
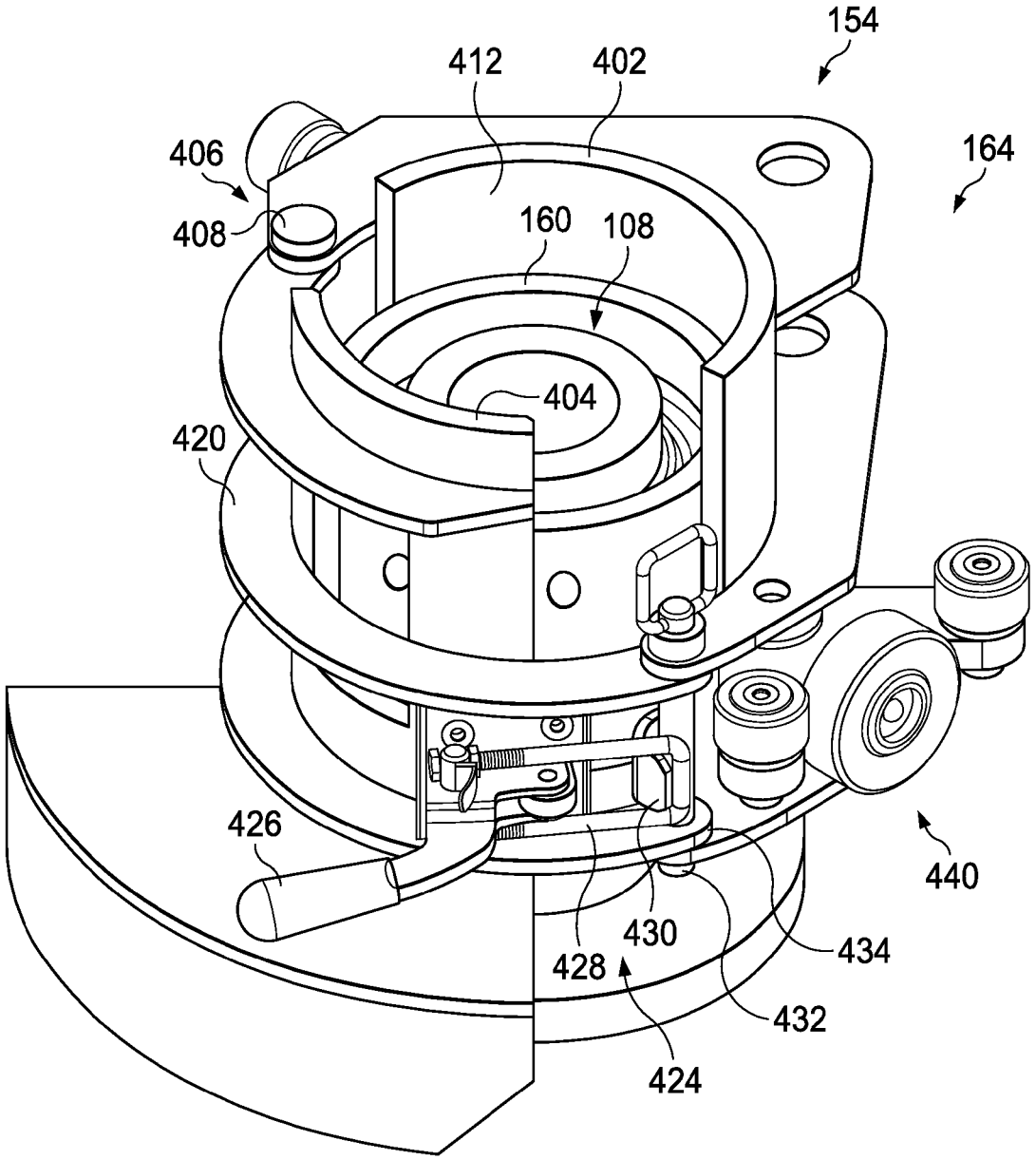
FIG. 10 is a perspective view of an apparatus in a closed condition about a portion of a column racker according to one or more aspects of the present disclosure.

FIGS. 9 and 10 show the bearing assembly 154 forming a part of the upper trolley 164. FIG. 9 shows the bearing assembly 154 in an open configuration and FIG. 10 shows the bearing assembly 154 in a closed configuration about the extension portion 160, which forms a part of the column racker 108. The bearing assembly 154 includes a stationary shell portion 402 and a pivoting shell portion 404. The stationary shell portion 402 is stationary relative to the upper trolley 164, while the pivoting shell portion 404 may open and close about one or more joints 406, such as the hinge joints shown. Here, the joints 406 are formed of pins 408 extending through hinge portions.

The stationary and pivoting shell portions 402, 404 have respective cylindrical concave interiors 412, 414 configured to receive and provide side-support to the extension portion 160 of the column racker 108. In some embodiments, the concave interiors 412, 414 of the shell portions 402, 404 have the same radius. The stationary shell portion 402 includes a horizontal slot 416 formed therein from one edge. The exemplary embodiment in FIGS. 9 and 10 include wheels and supports and arrangements 440 that enable the upper trolley 164 to advance along a track on the fingerboard (FIG. 1) or otherwise displace during use.

In use, the bearing assembly 154 is arranged so that the opening to the concave interior 412 of the stationary shell portion 402 faces toward the mast (FIG. 1). Accordingly, the column racker 104 may be pivoted about its lower end portion 144 so that the upper end portion 142 is received in the concave interior 412 of the stationary shell portion 402. In this embodiment, the bearing assembly 154 includes an automatically actuated closing system 418 that rotates the pivoting shell portion 404 to a closed position in a manner to capture the column racker 104 between the two shell portions 402, 404. The automatically actuated closing system 418 includes an actuating lever 420 that is attached to the pivoting shell portion 404 and extends in front of the opening to the concave interior 412 of the stationary shell portion 402. The actuating lever 420 is therefore engaged by the column racker 108 when it is introduced into the stationary shell portion 402. As the column racker 108 advances into the stationary shell portion 402, it pushes against and displaces the actuating lever 420. Since the actuating lever 420 is attached to the pivoting shell portion 404, the pivoting shell portion 404 continues to rotate from its open position to a closed position, where the column racker 104 is captured between the stationary and the pivoting shell portions 402, 404. As the pivoting shell portion 404 closes about the column racker 104, the actuating lever 420 passes through the slot 416 in the stationary shell portion 402.

With the column racker 108 captured in the bearing assembly 154, the pivoting shell portion 404 may be locked in the closed position with a latching mechanism 424. In this embodiment, the latching mechanism 424 includes a handle 426, a latch 428, and a tongue 430. In some embodiments, the latch 428 automatically latches, while in other embodiments, the latch 428 must be actuated manually. A safety pin 432 may provide a redundant lock as it may be introduced or removed into a support 434 on the pivoting shell portion 404. In some embodiments, a part of the support 434 also is the same component that forms the actuating lever 420. With the bearing assembly 154 closed and latched, the column racker 108 is secured to the upper trolley 164 and may be driven about via the upper trolley 164. The shell portions 402, 404 act as pillow blocks or bearings that allow the column racker 108 to rotate about its axis.

It should be understood that the column racker may be torn down and removed from the drilling rig floor without the use of cranes by performing the methods described herein in reverse, and such is considered within the scope of this disclosure. For example, the upper racker portion 142 may be disconnected from the bearing assembly 154 forming the fingerboard interface and connected to the hoisting components. The lower racker portion 144 may be disconnected from the racker trolley 112, and then lifted by the hoisting components off the racker trolley 112. It may be placed on and connected to the assembly trolley 150. With the column racker 108 carried on the assembly trolley 150 and suspended by the hoisting components, the column racker 108 is ready to be removed from the drill floor 102 in one piece without the use of cranes. The hoisting components may be lowered and the lower end of the column racker 108 may roll off the drill floor 102 and onto the ramp 130 or ground 107. It may roll adjacent to or over the skid 133 so that the lift structure 132 can be raised and placed to provide support to the column racker 108 as it is gradually lowered by the hoisting components. When sufficiently lowered, the column racker 108 may be disconnected from the hoisting equipment and supported by the lift structure 132 and the assembly trolley 150 until is lowered to a horizontal position on the skid or ground. It may then be disassembled for transportation from the drill site.

The systems and methods described herein may enable rig operators to more quickly and efficiently assemble a drilling rig apparatus by introducing the column racker adjacent to and over the rig floor in a complete and assembled piece without the use of cranes. Because it is introduced in a complete and assembled piece, an operator need only connect hoses and electrical connectors to the column racker once the column racker is properly placed in a vertical condition on the rig floor. This arrangement may increase rig set up efficiency as well as rig take down because the column racker 108 may be assembled in its complete condition on the ground prior to introducing it to the drilling rig.

In view of all of the above and the figures, one of ordinary skill in the art will readily recognize that the present disclosure introduces a method for erecting a drilling structure on a drilling rig, which may comprise: hoisting a first end of a column racker with a support carried by a mast on the drilling rig while the column racker is in a first position off the drilling rig; and advancing a second end of a column racker along a solid surface toward the mast while simultaneously hoisting the first end of the column racker to move the column racker toward a second position that is closer to vertical than the first position on the drilling rig.

In some aspects, advancing a second end of a column racker comprises rolling the second end on an assembly trolley. In some aspects, the assembly trolley is releasably attachable to the second end of the column racker. In some aspects, rolling a second end of a column racker along a solid surface comprises rolling the assembly trolley along a ramp to a rig floor of the drilling rig. In some aspects, the method includes raising the first end of a column racker with a ground supported lift structure to a position for introduction to the drilling rig. In some aspects, the method includes comprises lifting the column racker away from the assembly trolley and above a rig floor with a lifting element. In some aspects, the method includes pivotably securing the second of the column racker to a pivot point, and pivoting the first end of the column racker toward a vertical position for coupling to a travelling assembly disposed above the rig floor. In some aspects, the method includes securing the first end of the column racker to a travelling assembly associated with a fingerboard. In some aspects, the method includes locating a racker trolley under the column racker and disposing the column racker over the racker trolley, the racker trolley being arranged to displace the column racker during drilling operations. In some aspects, the travelling assembly comprises an upper trolley arranged to displace the column racker during drilling operations.

The present disclosure also introduces a method for erecting a drilling structure on a drilling rig, which comprises: raising a first end of a column racker with a ground-based, powered lift structure; and introducing the first end of the column racker over the rig floor while supporting a portion of the weight of the column racker with the ground-based, powered lift structure.

In some aspects, the powered lift structure comprises a hydraulic arm moveable by pivoting about a connection point or by telescoping from a retracted position to an extended position in a manner that raises the first end of the column racker. In some aspects, the method includes advancing a second end of the column racker along a solid surface toward the drilling rig while simultaneously introducing the first end of the racker over the rig floor. In some aspects, advancing a second end of a column racker comprises rolling the second end on an assembly trolley having wheels. In some aspects, the method includes rolling the second end along a ramp from ground level toward the rig floor. In some aspects, the method includes securing the first end of the column racker to a travelling assembly associated with the fingerboard. In some aspects, the travelling assembly comprises an upper trolley arranged to displace the column racker during drilling operations. In some aspects, the method includes moving the column racker from the assembly trolley over a racker trolley, the racker trolley being arranged to displace the column racker during drilling operations.

The present disclosure also introduces a method for erecting a drilling structure that includes raising an upper end of a column racker with a ground-based, powered lift structure; connecting the upper end of the column racker to a hoisting system carried by the rig mast; supporting a portion of the weight of the column racker on an assembly trolley device disposed at a lower end of the column racker; and raising the upper end of the column racker with the hoisting system and simultaneously driving the assembly trolley to the rig floor.

In some aspects, the method includes raising the column racker with the hoist off the assembly trolley so that it is suspended in air; displacing the lower portion of the column racker or the racker trolley so that the lower portion of the column racker is above the racker trolley; and lowering the column racker onto the racker trolley, the racker trolley arranged to displace the column racker during drilling operations. In some aspects, the method includes securing the first end of the column racker to a travelling assembly associated with a fingerboard. In some aspects, the method includes rolling the assembly trolley up a ramp to a drill floor on the drilling rig.

The present disclosure also introduces a method for erecting a drilling structure on a drilling rig, which comprises: providing a column racker in a horizontal condition; attaching the column racker to a traveling assembly carried by a mast at a single axial location along the column racker; and hoisting the column racker to an operational position, wherein all hoisting occurs only from the single axial location.

In some aspects, the method includes advancing a trailing end of a column racker along a solid surface toward the mast while simultaneously hoisting the column racker to move the column racker toward the operational position. In some aspects, attaching the column racker at a single axial location along the column racker comprises attaching the column racker at a leading end portion of the column racker.

The present disclosure also introduces an apparatus including a drilling rig apparatus that includes: a drilling rig floor having a moveable lower trolley disposed thereon; a mast extending upwardly above the drilling rig floor, the mast supporting a fingerboard above the rig floor and also supporting a hoisting system, the fingerboard supporting an upper trolley thereon; a column racker configured to grasp and move tubulars between well center and the fingerboard, the column racker being coupleable to the upper trolley and to the lower trolley. The apparatus also includes a ramp leading from a position off the drilling rig apparatus to the drilling rig floor; and an assembly trolley configured to connect to a lower end of the column racker and to move across the ramp to the drilling rig floor in a manner that supports weight of the column racker as the column racker is introduced above the rig floor. The hoisting system is configured to hoist tubulars during operation of the drilling rig apparatus and also configured to raise an upper end portion of the column racker during assembly of the drilling rig apparatus.

Some aspects include a ground-based powered lift structure arranged to support a portion of weight of the column racker when the column racker is lifted over the drilling rig floor. In some aspects, the drilling rig floor comprises a lifting element configured to vertically raise the column racker off the assembly trolley and onto the lower trolley.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method for erecting a drilling structure on a drilling rig, which comprises:

hoisting a first end of a column racker with a support carried by a mast on the drilling rig while the column racker is in a first position off the drilling rig; and advancing a second end of a column racker along a solid surface toward the mast while simultaneously hoisting the first end of the column racker to move the column racker toward a second position that is closer to vertical than the first position on the drilling rig.

2. The method of claim 1, wherein advancing a second end of a column racker comprises rolling the second end on an assembly trolley.

3. The method of claim 2, wherein the assembly trolley is releasably attachable to the second end of the column racker.

4. The method of claim 2, wherein rolling a second end of a column racker along a solid surface comprises rolling the assembly trolley along a ramp to a rig floor of the drilling rig.

5. The method of claim 1, which comprises raising the first end of a column racker with a ground supported lift structure to a position for introduction to the drilling rig.

6. The method of claim 2, which comprises lifting the column racker away from the assembly trolley and above a rig floor with a lifting element.

7. The method of claim 6, which comprises pivotably securing the second end of the column racker to a pivot point, and pivoting the first end of the column racker toward a vertical position for coupling to a travelling assembly disposed above the rig floor.

8. The method of claim 7, which comprises securing the first end of the column racker to a travelling assembly associated with a fingerboard.

9. The method of claim 6, which comprises locating a racker trolley under the column racker and disposing the column racker over the racker trolley, the racker trolley being arranged to displace the column racker during drilling operations.

10. The method of claim 7, wherein the travelling assembly comprises an upper trolley arranged to displace the column racker during drilling operations.

11. A method for erecting a drilling structure on a drilling rig, which comprises:

raising a first end portion of a column racker with a ground-based, powered lift structure;

introducing the first end portion of the column racker over a rig floor while supporting a portion of a weight of the column racker with the ground-based, powered lift structure;

raising the first end portion of the column racker over the rig floor so that the column racker is closer to vertical while a second end portion of the column racker is supported by the ground-based powered lift structure;

displacing the column racker with an upper or lower travelling assembly moveable relative to a mast on the drilling rig;

lifting the column racker to a substantially vertical operating position on the drilling rig; and operating the column racker to move tubulars between a well center on the drilling rig and a fingerboard on the drilling rig.

12. The method of claim 11, wherein the powered lift structure comprises a hydraulic arm moveable by pivoting about a connection point or by telescoping from a retracted position to an extended position in a manner that raises the first end of the column racker.

13. The method of claim 11, comprising advancing the second end portion of the column racker along a solid surface toward the drilling rig while simultaneously introducing the first end portion of the column racker over the rig floor.

14. The method of claim 13, wherein advancing the second end portion of the column racker comprises rolling the second end portion on an assembly trolley having wheels.

15. The method of claim 14, which further comprises rolling the second end portion along a ramp from ground level toward the rig floor.

16. The method of claim 11, which comprises securing the first end portion of the column racker to a travelling assembly associated with a fingerboard.

17. The method of claim 16, wherein the travelling assembly comprises an upper trolley arranged to displace the column racker during drilling operations.

18. The method of claim 14, which comprises moving the column racker from the assembly trolley over a racker trolley, the racker trolley being arranged to displace the column racker during drilling operations.

19. A method for erecting a drilling structure, comprising:

raising an upper end of a column racker with a ground-based, powered lift structure;

connecting the upper end of the column racker to a hoisting system carried by a rig mast;

supporting a portion of a weight of the column racker on an assembly trolley device disposed at a lower end of the column racker; and raising the upper end of the column racker with the hoisting system and simultaneously driving the assembly trolley to a rig floor.

20. The method of claim 19, comprising:

raising the column racker with the hoisting system off the assembly trolley so that it is suspended in air;

displacing the lower portion of the column racker or the racker trolley so that the lower portion of the column racker is above the racker trolley; and lowering the column racker onto the racker trolley, the racker trolley arranged to displace the column racker during drilling operations.

21. The method of claim 19, which comprises securing the upper end of the column racker to a travelling assembly associated with a fingerboard.

22. The method of claim 19, which comprises rolling the assembly trolley up a ramp to a drill floor on the drilling structure.

23. A method for erecting a drilling structure on a drilling rig, which comprises:

providing a column racker in a horizontal condition;

attaching the column racker to a travelling assembly carried by a mast at a single axial location along the column racker; and hoisting the column racker to an operational position, wherein all hoisting occurs only from the single axial location.

24. The method of claim 23, comprising:

advancing a trailing end of a column racker along a solid surface toward the mast while simultaneously hoisting the column racker to move the column racker toward the operational position.

25. The method of claim 23, wherein attaching the column racker at a single axial location along the column racker comprises attaching the column racker at a leading end portion of the column racker.

26. An apparatus comprising:

a drilling rig apparatus comprising:

a drilling rig floor having a moveable lower trolley disposed thereon;

a mast extending upwardly above the drilling rig floor, the mast supporting a fingerboard above the rig floor and also supporting a hoisting system, the fingerboard supporting an upper trolley thereon;

a column racker configured to grasp and move tubulars between well center and the fingerboard, the column racker being coupleable to the upper trolley and to the lower trolley;

a ramp leading from a position off the drilling rig apparatus to the drilling rig floor; and an assembly trolley configured to connect to a lower end of the column racker and to move across the ramp to the drilling rig floor in a manner that supports weight of the column racker as the column racker is introduced above the rig floor;

wherein the hoisting system is configured to hoist tubulars during operation of the drilling rig apparatus and also configured to raise an upper end portion of the column racker during assembly of the drilling rig apparatus.

27. The apparatus of claim 26, comprising a ground-based powered lift structure arranged to support a portion of weight of the column racker when the column racker is lifted over the drilling rig floor.

28. The apparatus of claim 26, wherein the drilling rig floor comprises a lifting element configured to vertically raise the column racker off the assembly trolley and onto the lower trolley.

* * * * *